US009033480B2

(12) United States Patent
Tremel

(10) Patent No.: US 9,033,480 B2
(45) Date of Patent: May 19, 2015

(54) SYSTEM AND PROCESS FOR LIQUID REPLENISHMENT FOR A PRINTING APPARATUS FOR DEPOSITING A LIQUID COMPOSITION ON A BACKPLANE

(71) Applicant: E I DU PONT DE NEMOURS AND COMPANY, Wilmington, DE (US)

(72) Inventor: James Daniel Tremel, Santa Barbara, CA (US)

(73) Assignee: E I DU PONT DE NEMOURS AND COMPANY, Wilmington, DE (US)

( * ) Notice: Subject to any disclaimer, the term of this patent is extended or adjusted under 35 U.S.C. 154(b) by 0 days.

(21) Appl. No.: 14/197,841

(22) Filed: Mar. 5, 2014

(65) Prior Publication Data

US 2014/0253616 A1 Sep. 11, 2014

Related U.S. Application Data

(60) Provisional application No. 61/773,532, filed on Mar. 6, 2013.

(51) Int. Cl.

| | |
|---|---|
| ***B41J 2/18*** | (2006.01) |
| ***B41J 2/175*** | (2006.01) |
| ***B41J 3/407*** | (2006.01) |

(52) U.S. Cl.

CPC ..... *B41J 2/17566* (2013.01); *B41J 2/17509* (2013.01); *B41J 3/407* (2013.01)

(58) Field of Classification Search

CPC .... B41J 2/175; B41J 2/17556; B41J 2/17566; B41J 2/17596; B41J 2/18

USPC ..... 347/7, 19, 84–86, 89

See application file for complete search history.

(56) References Cited

U.S. PATENT DOCUMENTS

| | | | | |
|---|---|---|---|---|
| 5,473,350 | A | 12/1995 | Mader et al. | |
| 6,935,729 | B2 * | 8/2005 | De Marco et al. | 347/73 |
| 7,594,717 | B2 * | 9/2009 | Sheinman | 347/89 |

* cited by examiner

*Primary Examiner* — An Do

(57) ABSTRACT

A liquid replenishment system for a printing apparatus that includes a dispensing nozzle and a supply reservoir is improved by a replenishment system having a volume control network responsive to a signal representative of the volume of liquid within the reservoir for generating a volume control signal. The volume control signal is applied to a pump operable to inject replenishment liquid from a replenishment source into the reservoir. The replenishment liquid is injected at a pressure at least substantially equal to the pressure in the reservoir and at a flow rate selectable in accordance with the volume control signal such that the volume of liquid in the reservoir is maintained at a predetermined reference level. A temperature control network for adjusting the temperature of the replenishment liquid to a temperature that lies within a predetermined range of the temperature of the liquid in the reservoir may also be provided.

5 Claims, 1 Drawing Sheet

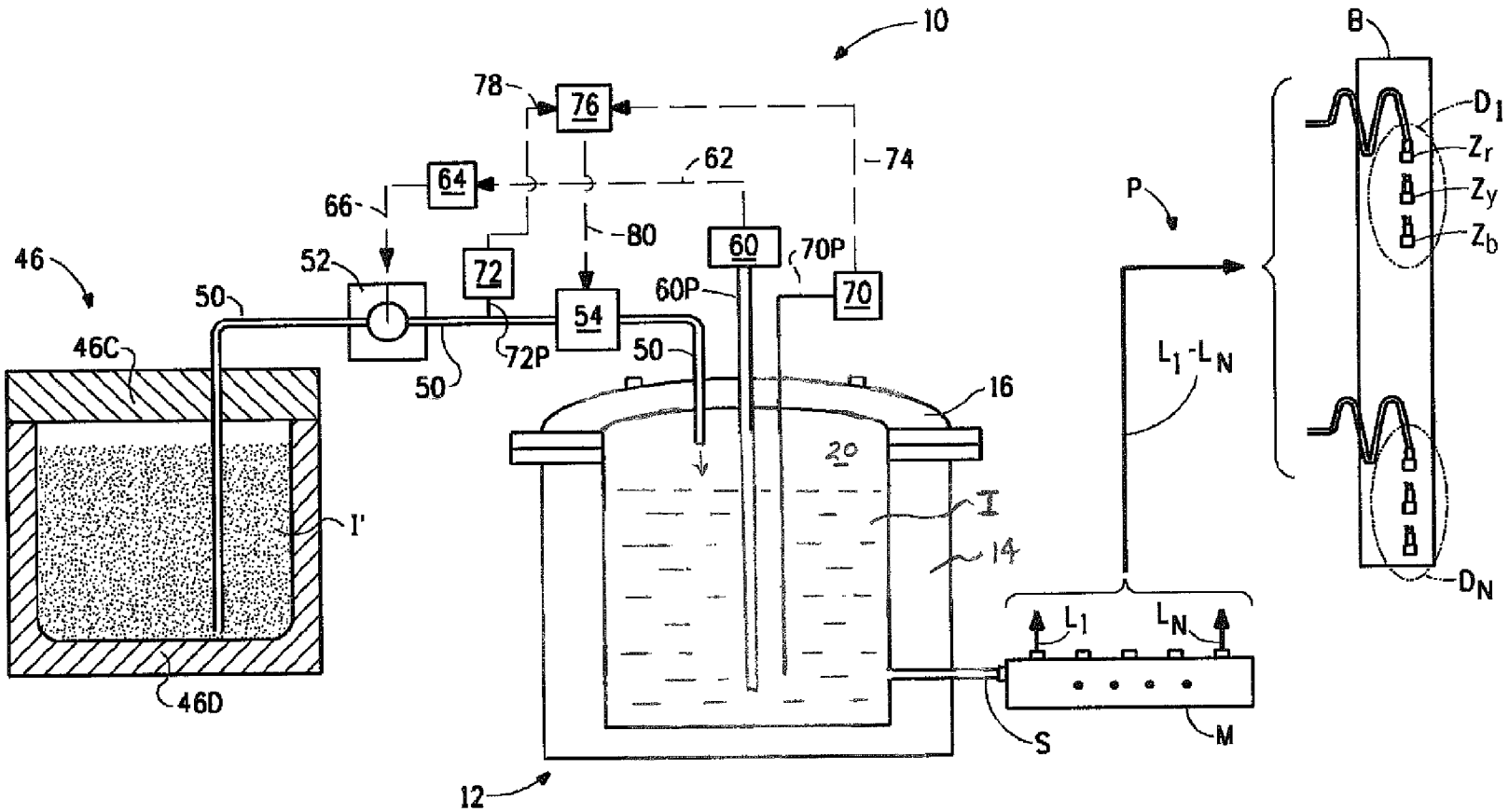
B
$D_1$
$Z_r$
$Z_y$
$Z_b$
$D_N$
P
$L_1$-$L_N$
$L_1$
$L_N$
M
S
10
12
14
16
I
20
70
70P
60
60P
62
74
76
78
80
54
72
72P
64
66
50
52
46
46C
46D
I'

SYSTEM AND PROCESS FOR LIQUID REPLENISHMENT FOR A PRINTING APPARATUS FOR DEPOSITING A LIQUID COMPOSITION ON A BACKPLANE

BACKGROUND OF THE INVENTION

1. Field of the Invention

This invention relates to a printing apparatus for depositing a liquid composition on a surface, such as the depositing of a liquid composition containing an organic semiconductor material on an backplane, and particularly to a system and corresponding method for replenishing the supply of the liquid composition.

2. Description of the Related Art

Organic electronic devices utilizing organic active materials are used in many different kinds of electronic equipment. The term "organic electronic device" is intended to mean a device, such as an organic light emitting diode (OLED), that includes one or more layers of organic semiconductor materials laminated between other supporting layers and sandwiched by two electrodes.

Each organic material is carried in a liquid composition. During manufacture of a device each liquid composition is dispensed from a dedicated nozzle carried by a dispensing bar. The nozzles are grouped in nozzle sets, with one nozzle in each set dispensing a particular color of ink. Each nozzle dispenses liquid and deposits that liquid along a longitudinal lane that extends across a backplane of the device. The nozzles in each set continuously dispense a liquid composition into a respective lane as the bar traverses the backplane.

The individual nozzles for each particular color in each nozzle set are supplied as a group from a common manifold itself supplied from a suitable nozzle supply source, or supply reservoir. The supply reservoir for each particular color is usually implemented as a communal reservoir. The supply reservoir may either directly hold a supply of liquid for the nozzles, or may hold a secondary container, such as a sealed pouch containing the particular colored liquid composition.

The supply reservoir used in the prior art includes an outer shell, or can, that is closed in an air-tight manner by a conjoinable cover. When conjoined the can and cover cooperate to define an enclosed interior chamber. The interior chamber of the supply reservoir contains an inert gas (e.g., nitrogen) that is held at a predetermined pressure above atmospheric pressure, typically a pressure level on the order of one hundred thirty pounds/square inch (130 psi; 0.9 MPa). The pressure of the inert gas in the interior chamber forces liquid from the supply reservoir or from the secondary container to the manifold, and from the manifold, through a dedicated flow line to a nozzle.

The holding capacity of the supply reservoir (or the secondary container) is limited, requiring that the ink supply in the supply reservoir be replenished as the liquid is consumed by the nozzles. Several factors serve to complicate ink replenishment.

Currently, replenishing the supply reservoir requires a shut-down of the printer and termination of nozzle discharge. The dispensing vessel is depressurized and its lid removed. With the resevoir open the secondary container must be either replaced or refilled. Once the supply reservoir is replenished with liquid the lid is re-attached and the reservoir is re-pressurized.

This arrangement and method for replenishing liquid is believed disadvantageous for several reasons.

On a system level care must be exercised to minimize the potential of nozzle failure due to plugging, which is more probable to occur during startup/shutdown phases than during steady operation of the system. The more often nozzles are turned off the greater is the chance for nozzle failure. Moreover, after starting a nozzle it takes a significant amount of time for the system to reach a steady flow rate. During this time the ink discharged from the nozzle is not useable and is wasted.

The act of replacing or refilling of the pouch (if a pouch is used as the secondary vessel) involves additional specific challenges beyond the disadvantages caused by the time-consuming disconnection and re-connection of the pouch to its associated manifold. These challenges include maintaining the pouch's structural integrity, avoiding gas entrapment in any supply lines, avoiding the introduction of atmospheric gases into the pouch, and monitoring the volume of liquid introduced into the back to prevent overfill and potential rupture of the pouch.

U.S. Pat. No. 5,473,350 (Mader et al.) discloses a system and method for maintaining ink concentration in a printing system. However, in the system disclosed in this patent it appears that the main ink supply reservoir is maintained under partial vacuum, rather than at a pressure greater than atmospheric pressure.

In view of the foregoing it is believed advantageous to provide an apparatus and method for continuously replenishing a liquid composition in the reservoir serving as the nozzle supply source without requiring disconnection or de-pressurization.

SUMMARY OF THE INVENTION

The present invention is directed to a system and a method for the replenishment of a nozzle supply reservoir operable to supply a liquid to a dispensing nozzle for depositing the liquid on a surface. The supply reservoir is operable to supply liquid to a nozzle at a predetermined pressure above atmospheric pressure.

In accordance with the present invention a volume sensor is operable to generate a signal representative of the volume of liquid within the reservoir. A volume control network operably associated with the volume sensor and responsive thereto generates a volume control signal that is applied to a pump. The pump is operable to inject replenishment liquid drawn from a liquid replenishment source into the reservoir. The replenishment liquid is injected at a pressure at least substantially equal to the pressure of the liquid held in the reservoir and at a flow rate selectable in accordance with the volume control signal such that the volume of liquid in the reservoir is maintained at a predetermined reference level.

A temperature sensor may also be provided to generate a signal representative of the temperature of a liquid within the reservoir. A temperature control network operably associated with the temperature sensor and responsive to the temperature signal therefrom generates a temperature control signal. A heat exchanger responsive to the temperature control signal is operable to adjust the temperature of the replenishment liquid to a temperature that lies within a predetermined range of the temperature of the liquid in the reservoir.

BRIEF DESCRIPTION OF THE DRAWINGS

The invention will be more fully understood from the following detailed description, taken in connection with the accompanying drawing, which forms a part of this application and in which:

FIG. 1 is a highly stylized pictorial representation illustrating a liquid replenishment system in accordance with various aspects of the present invention for continuously replenishing liquid to a supply reservoir of a printing apparatus.

DETAILED DESCRIPTION OF THE INVENTION

Throughout the following detailed description similar reference characters refers to similar elements in all FIGURES of the drawings.

FIG. 1 is a highly stylized pictorial representation of a system generally indicated by the reference character 10 for implementing a method for continuously replenishing a supply source supplying a liquid to dispensing nozzles in a printing apparatus, such as a printing apparatus useful to dispense a liquid composition onto the backplane of an organic light emitting device. The replenishment system 10 is associated with a nozzle supply source, or supply reservoir 12.

The printing apparatus is generally indicated by the reference character P. Elements of the printing apparatus P common to the prior art are indicated herein by alphabetic reference characters.

The printing apparatus P includes a dispensing bar B that carries N sets of dispensing nozzles, respectively indicated by the reference characters $D_1, \ldots D_N$. Typically, a bar may carry five or more nozzle sets. Each nozzle set includes a separate nozzle that discharges one of a plurality of different colored liquid compositions. Typically, each nozzle set D may contain a nozzle $Z_r$, $Z_g$, and $Z_b$ respectively dispensing a red, a green and a blue liquid composition.

The nozzle in each nozzle set for a given color, e.g., the nozzles $Z_r$ in the nozzle sets $D_1, \ldots D_N$, are supplied from a common manifold M. Thus, for example, each red nozzle $Z_r$ is supplied over a dedicated line $L_1, \ldots L_N$ from the common manifold $M_r$. Similar plumbing is provided for the nozzles for the other colors such as the manifolds $M_g$, and $M_b$, as the case may be. Each manifold $M_r$, $M_g$, and $M_b$ is itself supplied over a supply line S from its dedicated supply reservoir 12.

The reservoir 12 is implemented using an outer pressurized can 14 closed in an air-tight manner by a conjoinable cover 16. When conjoined the can 14 and cover 16 cooperate to define an enclosed interior chamber 20. The liquid ink I to be supplied to the manifold M (via the supply line S) and then to the nozzles is held in the interior chamber 20 of the supply reservoir 12. The liquid ink I in the supply reservoir 12 exhibits an ambient temperature and pressure profile.

In use, the supply reservoir 12 has an pressurized inert fluid, such as nitrogen gas, supplied thereto. The gas supply arrangement is not shown in FIG. 1 for economy of illustration. The gas is held at a predetermined pressure above atmospheric pressure. Typically the pressure level within the chamber 20 is on the order of one hundred thirty pounds/square inch (130 psi; 0.9 MPa).

The replenishment system 10 in accordance with the present invention is operable to continuously and automatically replenish the supply of ink I in the supply reservoir 12. To this end the replenishment system 10 includes a receptacle 46 that serves as a source of replenishment liquid I'. In the embodiment illustrated the receptacle 46 is implemented in the form of a drum 46D closed in an air-tight manner by an associated cap 46C. The interior of the receptacle is held at a pressure lower than the pressure in the chamber 20 of the supply reservoir 12. The pressure in the receptacle is near atmospheric pressure.

Replenishment liquid flow from the receptacle 46 is carried to the supply reservoir 12 by a supply line 50. Opposite respective ends of the line 50 extend in a sealed manner through the cap 46C and the cover 16. A pump 52 and a heat exchanger 54 are connected in the supply line 50 for purposes to be described.

Suitable for use as the pump is a high pressure liquid chromatography piston-type injection pump such as the Prep 100 Preparative Digital Pumps available from Chrom Tech, Inc., Apple Valley, Minn. This pump is controllable for flow rates in the range from 0.1 to 100 mL/min at pressures up to 4,000 psi. Other pump designs, such as a diaphragm pump or a gear pump may also be suitable. Whatever the form of pump used, it is important that the internal parts of the pump that are contacted by the replenishment liquid are fabricated from a non-elastomeric material, such as stainless steel, polytetrafluoroethylene or sapphire.

The probe 60P of a volume monitoring device 60 extends in a sealed manner through the cover 16 into the interior volume of the supply reservoir 12. The sensor 60 is operable to monitor the volume of liquid in the supply reservoir 12 as the same is being depleted by the nozzles. The sensor 60 generates a signal representative of the volume of liquid I within the supply reservoir 12 that is applied over a line 62 to a volume control network 64. The volume monitoring device 60 may be implemented using a liquid level sensor such as a capacitance point level switch such as that available from Endress and Hauser, Greenwood, Ind. as the "Liquicap M". A non-contact sensor such as laser displacement, ultrasonic, RF, sensor could be used.

In use, the volume control network 64 responds to the signal from the volume sensor 60 by generating a volume control signal that is output over a line 66 to the replenishment pump 52. The pump 52 draws replenishment liquid from the receptacle 46 and injects that replenishment liquid into the reservoir 12 at a pressure at least substantially equal to the pressure of the liquid therein. The control network 66 selectably modifies the flow rate of replenishment liquid drawn by the pump 52 such that the volume of liquid in the dispensing vessel 12 is maintained at a predetermined desired reference level.

The volume control network 64 may be realized using a programmable logic controller such as that available from Galil Motion Control, Rocklin, Calif. as "R1047200" implementing a proportional integral/differential algorithm The replenishment system 10 may further include a replenishment liquid temperature control system that includes temperature sensors 70, 72. The sensors respectively monitor the temperature of the liquid I in the dispensing vessel 12 and the temperature of the replenishment liquid I' being supplied thereto. In the arrangement illustrated in FIG. 1 the probe 70P from the sensor 70 extends in a sealed manner through the cover 16. The sensor 70 is operable to monitor the temperature of the liquid I held in the supply reservoir 12 and provide a signal representative of the same over a line 74 to a temperature control network 76. Similarly, the probe 72P of the temperature sensor 72 is disposed to monitor the temperature of the replenishment liquid I' in the line 50 and provide a signal representative thereof to the network 76 over a line 78. The sensors 70, 72 may be disposed in the system in any convenient alternative locations.

Suitable for use as the temperature sensors are high precision RTD probes.

In use, the temperature control network 76 compares a signal representative of the temperature of a liquid I within the supply reservoir 12 to a signal representative of the temperature of a replenishment liquid I' and generates a temperature control signal when the comparison indicates that the temperature of the replenishment liquid I' differs from the temperature the liquid I by a predetermined amount. The temperature signal is applied over a line 80 to the heat exchanger 54.

The heat exchanger 54 responds to the temperature control signal to adjust the temperature of replenishment liquid I' injectable by the pump 52 to a temperature that lies within a predetermined range of the temperature of the liquid I in the supply reservoir 12.

Although shown in the drawing as being disposed between the pump and the supply reservoir 12, it should be understood that the heat exchanger 54 may be connected at any convenient position within the system 10. The heat exchanger 54 may be implemented using, for example, a thermoelectric heating/cooling module or an electric resistance heater.

It should be appreciated from the foregoing description that the present invention serves to continuously replenish liquid to the supply reservoir 12 such that the volume of liquid therein is maintained at a predetermined reference level. Coordinated with the use of the temperature control arrangement herein described the injection of replenishment liquid into the supply reservoir is effected without undue disturbance of the ambient temperature and pressure profile of the liquid within the supply reservoir.

Those skilled in the art, having the benefit of the teachings of the present invention, may impart modifications thereto. Such modifications are to be construed as lying within the scope of the present invention, as defined by the appended claims.

What is claimed is:

1. In a printing apparatus for depositing a liquid on a surface, the printing apparatus including:

a dispensing nozzle; and a supply reservoir disposed in fluid communication with the dispensing nozzle, the reservoir being operable to hold a liquid at a predetermined pressure above atmospheric pressure for supply to the dispensing nozzle;

the improvement comprising a liquid replenishment system itself comprising:

a receptacle for storing a replenishment liquid;

a volume sensor operable to generate a signal representative of the volume of liquid within the reservoir;

a volume control network operably associated with the volume sensor and responsive to the volume signal therefrom for generating a volume control signal; and a pump responsive to the volume control signal, the pump being operable to inject the replenishment liquid from the receptacle into the reservoir at a pressure at least substantially equal to the pressure in the reservoir and at a flow rate selectable in accordance with the volume control signal such that the volume of liquid in the reservoir is maintained at a predetermined reference level, wherein the replenishment liquid is the same liquid as that in the reservoir.

2. The liquid replenishment system of claim 1 further comprising:

a temperature sensor operable to generate a signal representative of the temperature of the liquid within the reservoir;

a temperature control network operably associated with the temperature sensor and responsive to the temperature signal therefrom for generating a temperature control signal; and a heat exchanger responsive to the temperature control signal, the heat exchanger being operable to adjust the temperature of the replenishment liquid to a temperature that lies within a predetermined range of the temperature of the liquid in the reservoir.

3. A method for replenishing liquid in a printing apparatus that includes a dispensing nozzle and a supply reservoir disposed in fluid communication with the dispensing nozzle, the reservoir being operable to hold a liquid at a predetermined pressure above atmospheric pressure for supply to the dispensing nozzle, the method comprising the steps of:

(a) sensing the volume of liquid contained within the reservoir;

(b) generating a volume control signal based upon the sensed volume of liquid within the reservoir; and (c) pumping a liquid from a source of replenishment liquid into the reservoir at a pressure at least substantially equal to the pressure in the reservoir and at a flow rate selectable in accordance with the volume control signal such that the volume of liquid in the reservoir is maintained at a predetermined reference level, wherein the replenishment liquid is the same liquid as that in the reservoir.

4. The process of claim 3, wherein liquid stored in the reservoir exhibits an ambient temperature and pressure profile, and wherein the injection of replenishment liquid into the reservoir is effected without undue disturbance of the ambient temperature and pressure profile.

5. The process of claim 3 further comprising the steps of:

(d) sensing the temperature of a liquid contained within the reservoir;

(e) sensing the temperature of a replenishment liquid;

(f) comparing the temperature of the liquid in the reservoir to the temperature of the replenishment liquid; and (g) based upon the temperature comparison, adjusting the temperature of the replenishment liquid to a temperature that lies within a predetermined range of the temperature of the liquid in the reservoir.

* * * * *